US006997531B2

(12) United States Patent
Kim et al.

(10) Patent No.: US 6,997,531 B2
(45) Date of Patent: Feb. 14, 2006

(54) TRAY APPARATUS FOR REFRIGERATOR

(75) Inventors: Han-Hyo Kim, Changwon (KR); Moon-Won Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 15 days.

(21) Appl. No.: 10/909,555

(22) Filed: Aug. 3, 2004

(65) Prior Publication Data

US 2005/0006995 A1 Jan. 13, 2005

Related U.S. Application Data

(63) Continuation of application No. 10/458,241, filed on Jun. 11, 2003, now abandoned.

(51) Int. Cl.
*A47B 96/02* (2006.01)

(52) U.S. Cl. ..... 312/408; 312/319.3; 108/93; 108/136

(58) Field of Classification Search ..... 312/319.2, 312/319.3, 408; 108/42, 93, 96, 99, 136; 248/285.1

See application file for complete search history.

(56) References Cited

U.S. PATENT DOCUMENTS

| | | | | |
|---|---|---|---|---|
| 883,305 | A | 3/1908 | Fetch | 312/27 |
| 2,855,262 | A | 10/1958 | Sharpe | 312/325 |
| 3,722,973 | A | 3/1973 | Textoris | 312/325 |
| 4,941,718 | A | 7/1990 | Alexander, III et al. | 312/312 |
| 5,329,865 | A | 7/1994 | McWard | 109/50 |
| 6,402,243 | B1 | 6/2002 | Liu | 297/281 |
| 6,655,646 | B2 | 12/2003 | Johnson | 248/285.1 |
| 6,679,573 | B2 | 1/2004 | Bienick | 312/408 |

*Primary Examiner*—Peter R. Brown
(74) *Attorney, Agent, or Firm*—Fleshner & Kim, LLP.

(57) ABSTRACT

A tray apparatus for a refrigerator is provided which optimizes the use of storage space in the refrigerator. A position of the tray within a storage space of the refrigerator is varied through the use of elastic means which moves the tray toward an upper surface of the storage space as an article is stored thereon. The tray is supported by supporting links which are then connected through interlocking links so that they are integrally pivoted. The link mechanisms are supported on the upper surface of the storage space. Thus, a storage article with a relatively large bottom area can be easily stored in the vicinity of the upper surface of the storage space, which is usually out of use, thereby maximizing the use of the storage space in the refrigerator.

6 Claims, 7 Drawing Sheets

TRAY APPARATUS FOR REFRIGERATOR

This is a Continuation of prior application Ser. No. 10/458,241, filed on Jun. 11, 2003, now abandoned, entitled TRAY APPARATUS FOR REFRIGERATOR.

BACKGROUND OF THE INVENTION

1. Field of the Invention

The present invention relates to a refrigerator, and more particularly, to a tray apparatus for a refrigerator, which is designed to occupy a predetermined space only when articles are to be placed thereon, so that an interior space of the refrigerator can be efficiently utilized.

2. Description of the Prior Art

FIG. 1 is a perspective view showing a configuration of a general refrigerator. Referring to FIG. 1, a freezing chamber 3 and a refrigerating chamber 5, which serve as a storage space for keeping or storing articles therein, are formed within a refrigerator body 1. The freezing chamber 3 and the refrigerating chamber 5 are divided by a barrier 7. Thus, the interior temperatures thereof are set to be different from each other so that the articles can be stored individually according to respective features of the articles.

A plurality of shelves 8 are installed at a predetermined vertical interval within the freezing chamber 3 and the refrigerating chamber 5 so that the storage space can be efficiently utilized. The freezing chamber 3 and the refrigerating chamber 5 are shielded from the outside and opened selectively by the doors 9, respectively. Inner faces of the doors 9 are provided with a plurality of baskets 11 for keeping the articles therein. Reference numeral 5' is a vegetable container which is partitioned separately at a lower portion of the refrigerating chamber 5 so that vegetable or fruit is stored therein.

That is, the articles are stored in the freezing chamber 3 and the refrigerating chamber 5 of the refrigerator. More specifically, the articles are stored on the floor, the shelves 8 or in the baskets 11 of the freezing and refrigerating chambers 3 and 5, according to respective kinds and sizes of the articles.

However, there are the following problems in the aforementioned prior art.

An area in the freezing and refrigerating chambers 3 and 5, on which the articles can be placed, is generally limited. Thus, in order to store or keep a lot of articles in the chambers, the articles may be placed one above another. However, this results in the following inconvenience. That is, if any lower one of the stacked articles is to be taken out from the chamber, all the articles placed above the specific article should be displaced.

In particular, an article with a large bottom area, e.g. a pizza box or a flat article, occupies a large bottom area of the storage space, while a space above the article is left to be unused. Thus, there is another problem in that space efficiency is lowered. In such a case, other articles may be put on the top of the flat article such as the pizza box. However, it is still very inconvenient for a user to take out the pizza box or the like in a stacked state as mentioned above.

Furthermore, spaces in the vicinity of a ceiling surface of the storage space (for example, ceilings of the freezing and refrigerating chambers 3 and 5, bottom surfaces of the shelves 8, and the like) are not substantially often used for storing the articles. This is because the height of the article is generally lower than a distance between the adjacent shelves 8 or between one of the shelves 8 and the ceiling surface.

SUMMARY OF THE INVENTION

The present invention is conceived to solve the above problems in the prior art.

Accordingly, an object of the present invention is to provide a tray apparatus for a refrigerator by which an article with a large bottom area can be more efficiently received in a storage space of the refrigerator.

Another object of the present invention is to a tray apparatus for a refrigerator by which an upper portion of a storage space can be more efficiently utilized.

According to an aspect of the present invention for achieving the above objects, there is provided a tray apparatus for a refrigerator, which comprises a tray on which an article to be stored is placed, link mechanisms which support both sides of the tray such that the tray can be lifted to and lowered from a ceiling surface of a storage space, and holders for allowing the link mechanisms to be pivotally mounted to the ceiling surface of the storage space.

Preferably, each of the link mechanisms includes a plurality of supporting links which are pivotally mounted to the holder and pivotally support the tray on respective one ends thereof, and an interlocking link which connects the plurality of supporting links to one another to cause the ends of the supporting links to be pivoted through the same angle.

More preferably, each of the link mechanisms receives an elastic force from one of elastic members and causes the tray to be brought into close contact with the ceiling surface of the storage space.

Further, each of the elastic members may be connected to the relevant holder and interlocking link at both ends thereof so that the elastic force is applied in a direction in which the tray is brought into close contact with the ceiling surface of the storage space.

Furthermore, each of the elastic members may be installed at the centers of pivot of the supporting links so that the elastic force is applied in a direction in which the tray is brought into close contact with the ceiling surface of the storage space.

Preferably, connecting links are engaged with opposite ends of the supp orting links, respectively, at a predetermined angle with respect to longitudinal directions of the supporting links, and other ends of the connecting links are pivotally connected to relevant ends of the interlocking links.

The connecting links and the supporting links may be integrally pivoted.

A front end of the tray may be formed into a downwardly sloped portion that is curved downwardly.

The ceiling surface of the storage space may be one of a ceiling of a freezing chamber, a ceiling of a refrigerating chamber, and a bottom surface of any one of shelves.

According to the tray apparatus of the present invention, there are advantages in that the article with a relatively large bottom area can be efficiently stored in the refrigerator without using a floor surface of a storage space, and thus, the space efficiency of the storage space can be improved by using a space in the vicinity of a ceiling surface of the storage space in the refrigerator.

BRIEF DESCRIPTION OF THE DRAWINGS

The above and other objects, advantages and features of the present invention will become apparent from the following description of a preferred embodiment given in conjunction with the accompanying drawings, in which.

DETAILED DESCRIPTION OF THE INVENTION

Hereinafter, a tray apparatus for a refrigerator according to a preferred embodiment of the present invention will be explained in detail with reference to the accompanying drawings.

FIGS. 2–5 show the configuration of the tray apparatus for the refrigerator according to the preferred embodiment of the present invention. Referring to FIGS. 2–5, a tray 50 is formed in a substantially rectangular shape by arranging a plurality of wires on a frame of the tray. An article b to be stored is placed on the tray 50. The tray 50 may be made of various materials, e.g. a transparent plastic material. Bores 52 are installed on front and rear locations at both sides of a bottom face of the tray 50. The bores 52 at each side may be connected with each other.

A front end of the tray 50 is formed into a downwardly sloped portion 54 that is curved downwardly at a predetermined angle. The downwardly sloped portion 54 of the tray 50 causes a predetermined gap to be defined between the portion 54 and a ceiling surface c of the storage space when the tray 50 comes into close contact with the ceiling surface. Thus, a user can easily lower the tray 50 owing to the gap.

The tray 50 is supported at the ceiling surface c of the storage space through link mechanisms such that it can be lifted to or lowered from the ceiling surface. Supporting links 60 are first installed in such a manner that respective ends thereof are connected to the relevant bores 52 of the tray 50. In the preferred embodiment of the present invention, four supporting links 60 are utilized.

Figure 4A:
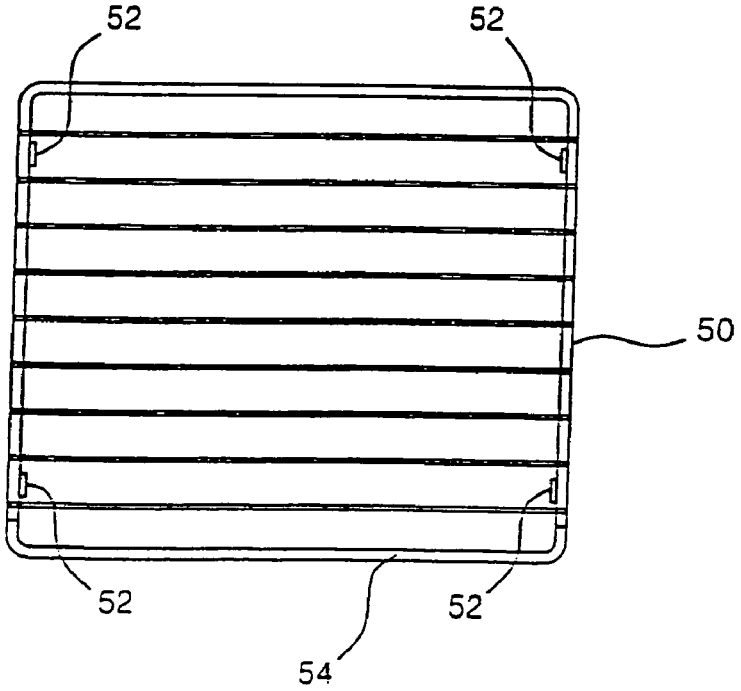
FIG. 4*a* is a plan view of the tray of the tray apparatus according to the embodiment of the present invention.
Figure 4B:
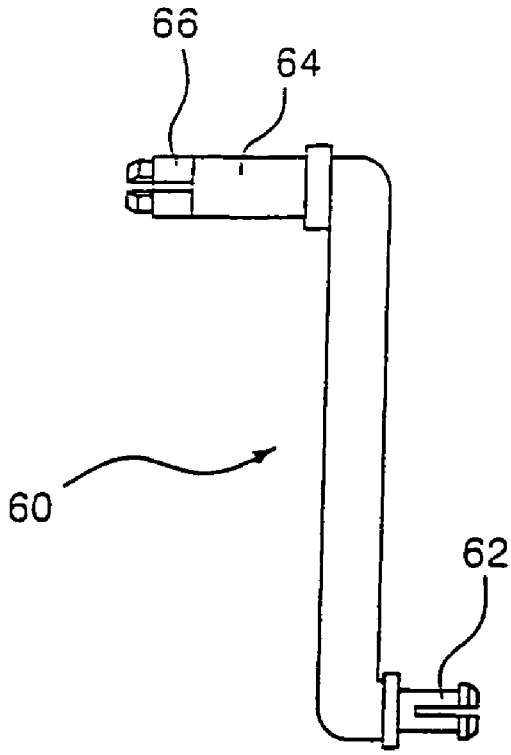
FIG. 4*b* is a side view of a supporting link of the tray apparatus according to the embodiment of the present invention.
Figure 4C:
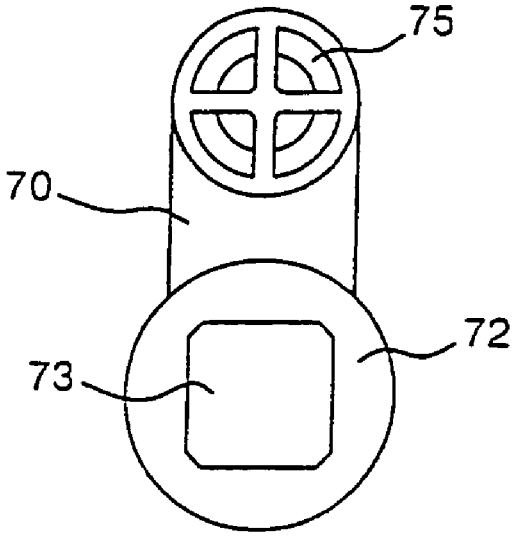
FIG. 4*c* is a front view of a connecting link of the tray apparatus according to the embodiment of the present invention.
Figure 4D:
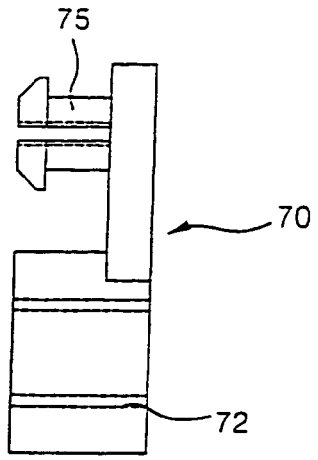
FIG. 4*d* is a side view of the connecting link of the tray apparatus according to the embodiment of the present invention.
Figure 4E:
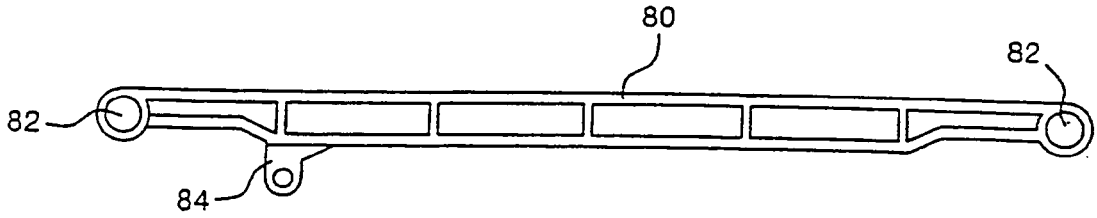
FIG. 4*e* is a front view of an interlocking link of the tray apparatus according to the embodiment of the present invention.
Figure 4F:
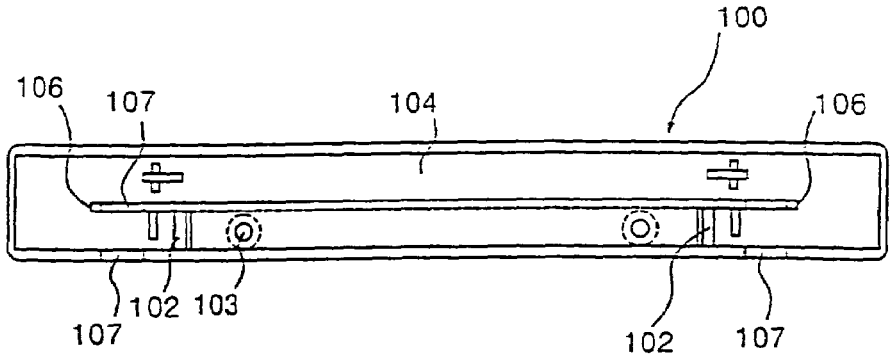
FIG. 4*f* is a front view of a holder of the tray apparatus according to the embodiment of the present invention.
Figure 4G:
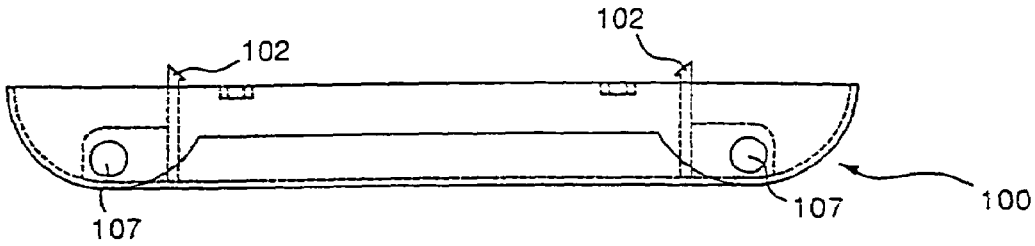
FIG. 4*g* is a plan view of the holder of the tray apparatus according to the embodiment of the present invention.

As clearly shown in FIG. 4*b*, each of the supporting links 60 is provided at one end thereof with an engaging hook 62 that protrudes in a direction perpendicular to a longitudinal direction of the supporting link 60. The engaging hook 62 is rotatably fitted into the bore 52 of the tray 50. At this time, the engaging hook 62 is not inadvertently removed from the bore 52 since it is fitted with a predetermined elastic force resulting from its own inherent shape.

Each of the supporting links 60 is provided at the other end thereof with a rotating shaft portion 64 that protrudes in a direction opposite to the direction of the engaging hook 62. The rotating shaft portion 64 is supported in one of holders 100 to be described later and becomes a center of pivot for the supporting link 60. An engaging hook 66 is provided at a tip end of the rotating shaft portion 64. The engaging hook 66 is used to cause the supporting link 60 to be fixed to one of connecting links 70 to be described later.

Each of the connecting links 70 is coupled to the engaging hook 66 of the relevant supporting link 60. At this time, the connecting link 70 is coupled in such a manner that its imaginary extension line intersects with an imaginary longitudinal extension line of the supporting link 60 at a predetermined angle between them. Further, the supporting link 60 and the connecting link 70 do not rotate with respect to each other. Therefore, the supporting link 60 and the connecting link 70 may be integrally formed with each other.

A fixing bore 72 is formed at an end of the connecting link 70. A hole 73 is formed within the fixing bore 72. The engaging hook 66 is inserted into the hole 73 so that the connecting link 70 and the supporting link 60 are engaged with each other. The hole 73 is substantially rectangular in cross section. An engaging hook 75 is formed at the other end of the connecting link 70. The engaging hook 75 is used to connect with one of interlocking links 80 to be described later.

Each of the interlocking links 80 allows a pair of supporting links 60 for supporting the one side of the tray 50 to rotate together at the same angle and is connected with the two connecting links 70. Engaging holes 82 are formed at both ends of each of the interlocking links 80, and the engaging hook 75 of the connecting link 70 is rotatably fitted into the relevant engaging hole 82. A connecting piece 84 is formed at one side of the interlocking link 80 so that one end of one of elastic members 90 to be described later is hooked thereto.

Each of the elastic members 90 provides an elastic force to the relevant link mechanism and causes the tray 50, which is lifted or lowered by the link mechanisms, to always come into close contact with the ceiling surface c of the storage space. The one end of the elastic member 90 is connected to the connecting piece 84, and the other end thereof is connected to a fixed portion such as one side of each of the holders 100 to be described later. In the embodiment, a coil spring has been used as the elastic member 90, but it is not necessarily limited thereto. A torsion spring, which imparts an elastic force to the supporting link 60 around the rotating shaft portion 64 of the supporting link 60, may be utilized.

In the meantime, the link mechanisms are supported on the ceiling surface c of the storage space by means of the holders 100. The holders 100 are installed at portions corresponding to the both sides of the tray 50, as clearly shown in FIGS. 4*f* and 4*g*. Hooks 102 for the attachment of the holder to the ceiling surface c and screw holes 103 are formed at both ends of each of the holders 100. A link receiving portion 104 is formed in the holder 100. The interlocking link 80, the elastic member 90, and the like are placed in the link receiving portion 104 corresponding to a space formed in a longitudinal direction of the holder 100.

Supporting ribs 106 are formed in the middle of the both ends of the holder 100, respectively. Link holes 107 are also formed on the supporting ribs and corresponding outer surfaces of the holder 100. The rotating shaft portion 64 of the supporting link 60 is fitted into and supported by the relevant one of the link holes 107 that penetrates through the supporting ribs 106 and the corresponding outer surfaces of the holder 100.

An operation of the tray apparatus of the present invention constructed as such will be hereinafter explained in detail.

First, it will be described how to assemble the tray apparatus according to the embodiment of the present invention. The holders 100 into which the link mechanisms are assembled are mounted on the ceiling surface c of the storage space. The holders 100 are installed at right and left portions of the ceiling surface of the storage space at a predetermined interval.

In each of the supporting links 60 of the link mechanisms, the rotating shaft portion 64 is fitted into the relevant holder 100 through the link hole 107, and the relevant connecting link 70 is fixed to the connecting hook 66. The relevant pair of connecting links 70 at fore and aft ends is connected via the relevant interlocking link 80. The interlocking link 80 is supported by the relevant elastic member 90 so that the associated supporting links 60 are subjected to the elastic force for causing them to be urged to the ceiling surface c of the storage space.

The tray 50 is connected to the lower ends of the supporting links 60 of the link mechanisms. The tray 50 is supported at the both sides by the supporting links 60, in which the engaging hooks 62 of the supporting links 60 facing each other inward the holders 100 at the both sides are rotatably inserted into the bores 52 provided on the front and rear locations at the both sides of the tray 50.

Figure 1:
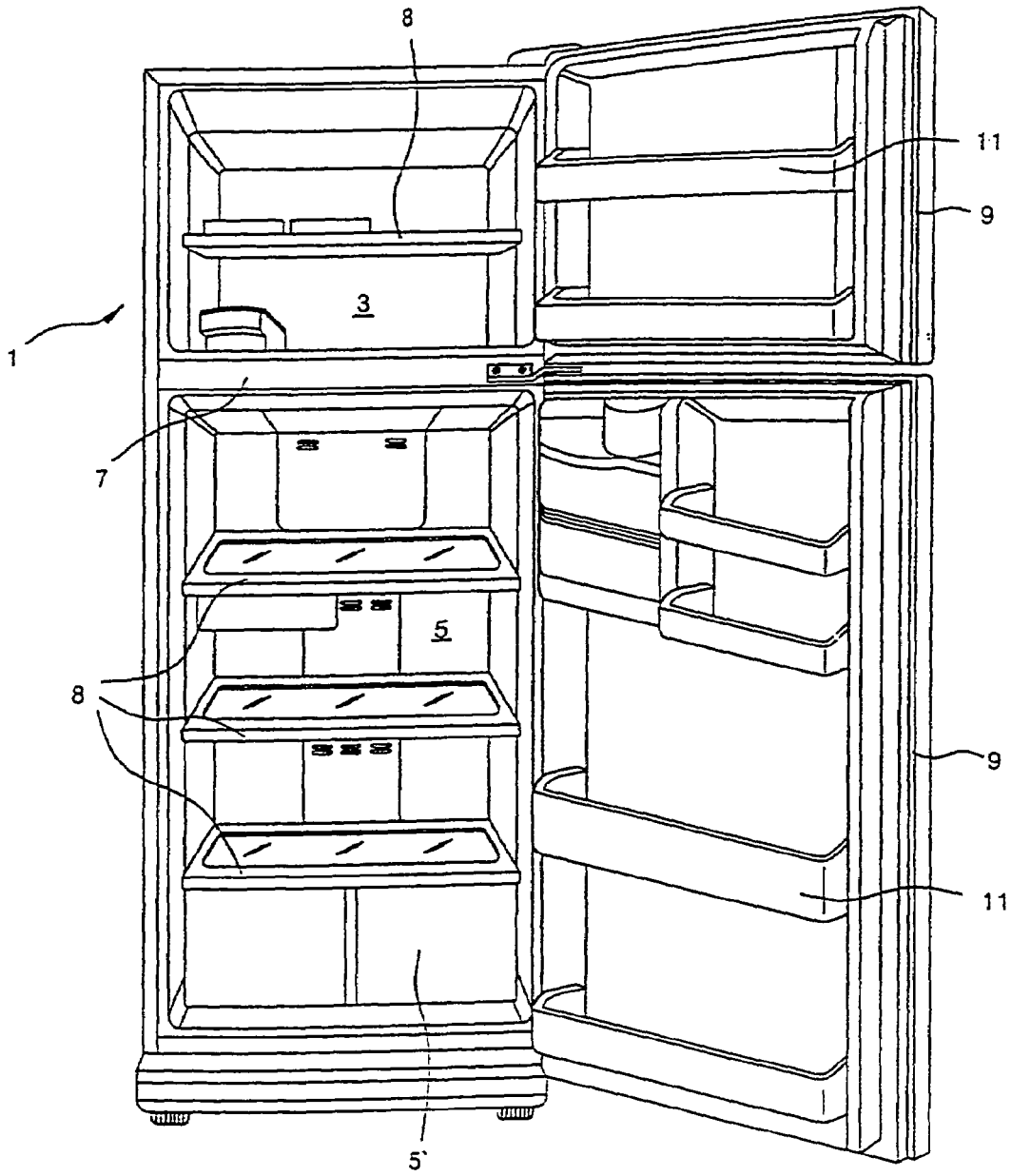
FIG. 1 ( PRIOR ART )
FIG. 1 is a perspective view showing an internal configuration of a general refrigerator.
Figure 2:
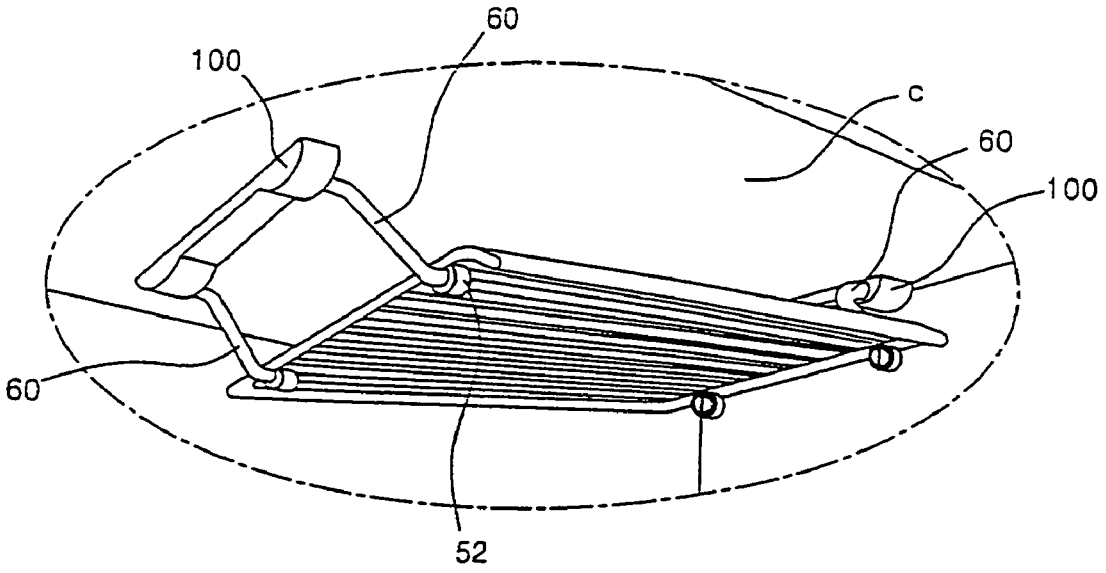
FIG. 2 is a perspective view showing a configuration of a tray apparatus for a refrigerator according to a preferred embodiment of the present invention.
Figure 3A:
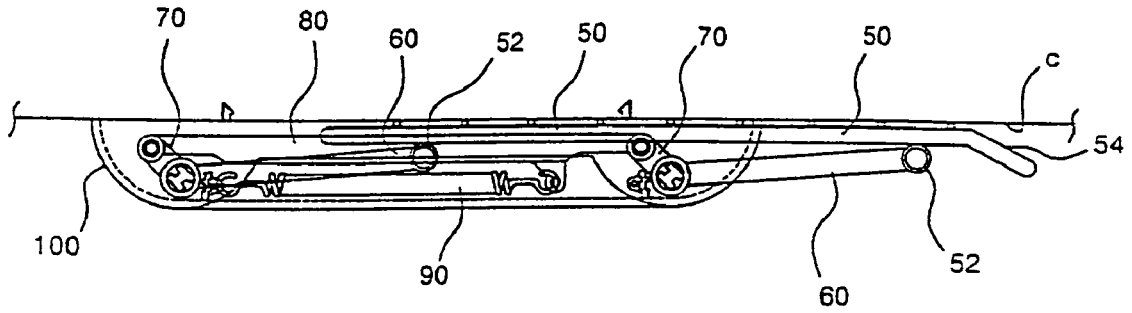
FIG. 3*a* is a side view showing a state where a tray of the tray apparatus according to the embodiment of the present invention is in close contact with a ceiling of a storage space.

When the tray 50 is installed at the lower ends of the supporting links 60 in such a way, the tray 50 is in close contact with the ceiling surface c of the storage space by means of the elastic forces of the elastic members 90, as shown in FIG. 3*a*. At this time, since the supporting links 60 are also rotated therewith to be urged to the ceiling surface c of the storage space, the connecting links 70 connected to opposite ends of the supporting links 60 are in the rotated state shown in FIG. 3*a*. Such rotation is achieved by the elastic forces of the elastic members 90. Therefore, the interlocking links 80 have been moved to a relatively left position as viewed in the figure.

Meanwhile, in order to lower the tray 50, a user merely grasps the downwardly sloped portion 54 formed at the front end of the tray 50 and exerts a force on the sloped portion so that the tray is moved downward and rearward. When the user exerts the force on the tray 50, the link mechanisms that support the tray 50 are pivoted while overcoming the elastic forces of the elastic members 90.

Figure 3B:
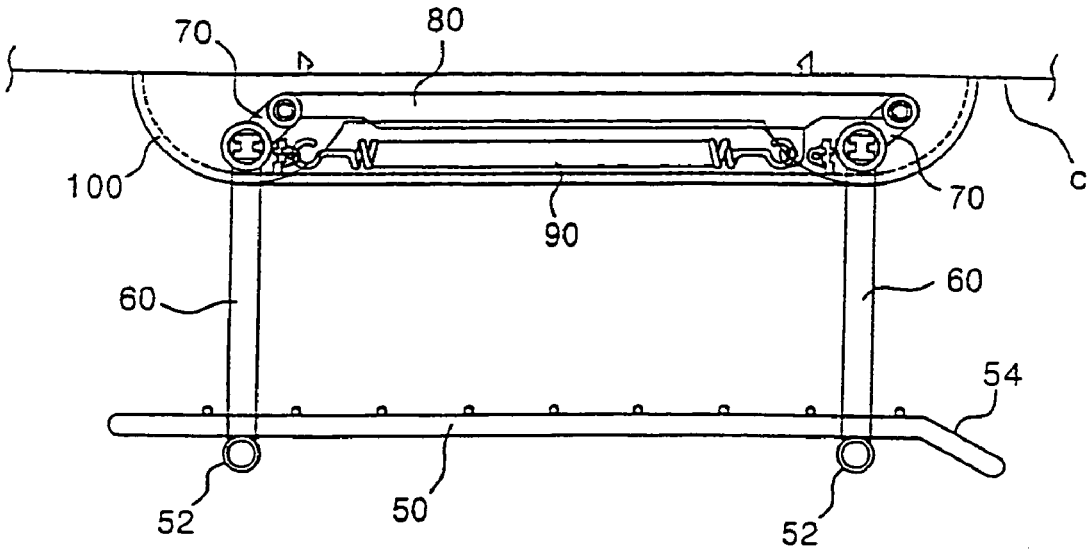
FIG. 3*b* is a side view showing a state where the tray of the tray apparatus according to the embodiment of the present invention is fully lowered from the ceiling.

That is, the supporting links 60 and the connecting links 70 are integrally pivoted on the rotating shaft portion 64 in a clockwise direction and the interlocking links 80 are moved rightward when viewed in the figure. FIG. 3*b* shows the state where the tray 50 is fully lowered.

Next, storing an article b on the tray 50 will be described. As shown in FIG. 3*b*, the article b such as a thin, hexahedral pizza box is placed on the tray 50 in the state where the tray 50 is fully lowered. When the user relinquishes his/her hold of the tray 50, the supporting links 60 and the connecting links 70 of the fink mechanisms are lifted while pivoting in a counterclockwise direction by means of the elastic forces of the elastic members 90.

Figure 5:
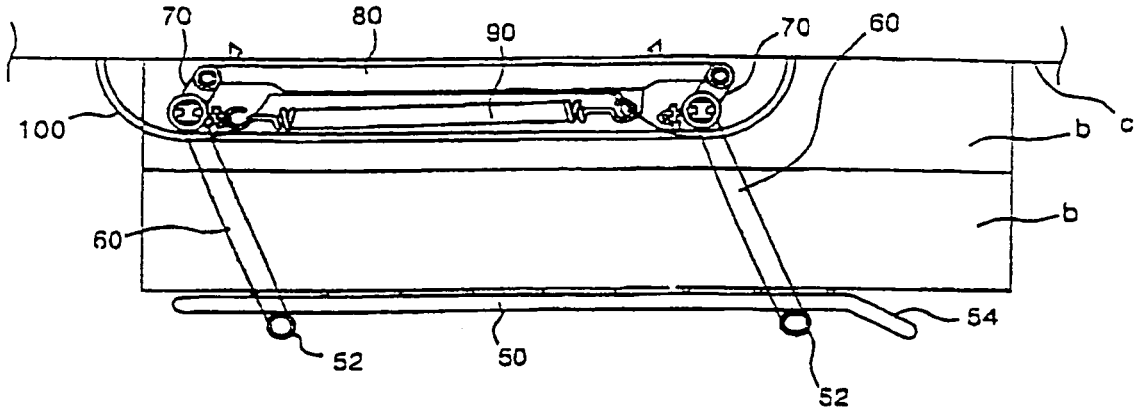
FIG. 5 is a side view illustrating how to operate the tray apparatus in a state where an article is placed on the tray of the tray apparatus according to the embodiment of the present invention.

The lift of the tray 50 continues until a top surface of the article b placed on the tray 50 comes into contact with the ceiling surface c of the storage space, so that the state shown in FIG. 5 is achieved. Therefore, the article b is stored in the state where it is in close contact with the tray 50 and the ceiling surface c of the storage space by means of the elastic forces of the elastic members 90.

Meanwhile, the ceiling surface c of the storage space on which the tray apparatus of the present invention is mounted may be a ceiling of the refrigerating chamber, a ceiling of the freezing chamber, a bottom surface of any one of shelves for vertically partitioning the refrigerating and freezing chambers, or the like.

As described above in detail, the tray apparatus for the refrigerator according to the present invention is configured in such a manner that the link mechanisms are installed to impart the elastic forces to the tray in a direction in which the tray is brought into close contact with the ceiling surface of the storage space. Thus, the article with a relatively large bottom area can be additionally stored in the vicinity of the ceiling surface of the storage space, which is usually out of use. Therefore, there is an advantage in that the storage space can be efficiently utilized.

Furthermore, when the tray apparatus is not in use, the tray is brought into close contact with the ceiling surface of the storage space. Thus, there is another advantage in that the tray apparatus does not further occupy an additional storage space.

The scope of the present invention is not limited to the embodiment described above but defined by the appended claims. It will be apparent that those skilled in the art can make various modifications and changes thereto within the scope defined by the claims.

What is claimed is:

1. A tray apparatus for a refrigerator, comprising:

a tray on which an article to be stored is placed;

link mechanisms which support both sides of the tray such that the tray can be lifted to and lowered from a ceiling surface of a storage space; and holders for allowing the link mechanisms to be pivotally mounted to the ceiling surface of the storage space, wherein each of the link mechanisms include:

a plurality of supporting links which are pivotally mounted to the holder and pivotally support the tray on respective one ends thereof; and an interlocking link which connects the plurality of supporting links to one another to cause the ends of the supporting links to be pivoted through the same angle, wherein each of the link mechanisms receives an elastic force from a corresponding elastic member connected to a relevant holder and interlocking link at both ends thereof such that an elastic force is applied in a direction which causes the tray to be brought into close contact with the ceiling surface of the storage space.

2. The tray apparatus as claimed in claim 1, wherein a front end of the tray is formed into a downwardly sloped portion that is curved downwardly.

3. The tray apparatus as claimed in claim 1, wherein the ceiling surface of the storage space is one selected from a group consisting of a ceiling of a freezing chamber, a ceiling of a refrigerating chamber, and a bottom surface of any one of shelves.

4. A tray apparatus for a refrigerator, comprising:

a tray on which an article to be stored is placed;

link mechanisms which support both sides of the tray such that the tray can be lifted to and lowered from a ceiling surface of a storage space; and holders for allowing the link mechanisms to be pivotally mounted to the ceiling surface of the storage space, wherein each of the link mechanisms include:

a plurality of supporting links which are pivotally mounted to the holder and pivotally support the tray on respective one ends thereof; and an interlocking link which connects the plurality of supporting links to one another to cause the ends of the supporting links to be pivoted through the same angle, wherein each of the link mechanisms receives an elastic force from a corresponding elastic member installed at the centers of pivot of the supporting links such that an elastic force is applied in a direction which causes the tray to be brought into close contact with the ceiling surface of the storage space.

5. A tray apparatus for a refrigerator, comprising:

a tray on which an article to be stored is placed;

link mechanisms which support both sides of the tray such that the tray can be lifted to and lowered from a ceiling surface of a storage space;

holders for allowing the link mechanisms to be pivotally mounted to the ceiling surface of the storage space; and connecting links engaged with opposite ends of the supporting links, respectively, at a predetermined angle with respect to longitudinal directions of the supporting links, with other ends of the connecting links pivotally connected to relevant ends of the interlocking links, wherein each of the link mechanisms include:

a plurality of supporting links which are pivotally mounted to the holder and pivotally support the tray on respective one ends thereof; and an interlocking link which connects the plurality of supporting links to one another to cause the ends of the supporting links to be pivoted through the same angle.

6. The tray apparatus as claimed in claim 5, wherein the connecting links and the supporting links are integrally pivoted.

* * * * *